US010035254B2

(12) United States Patent
Murphy

(10) Patent No.: US 10,035,254 B2
(45) Date of Patent: Jul. 31, 2018

(54) VERSATILE EXTENSION GRIP

(71) Applicant: Marc David Murphy, Eliot, ME (US)

(72) Inventor: Marc David Murphy, Eliot, ME (US)

( * ) Notice: Subject to any disclaimer, the term of this patent is extended or adjusted under 35 U.S.C. 154(b) by 173 days.

(21) Appl. No.: 15/079,970

(22) Filed: Mar. 24, 2016

(65) Prior Publication Data

US 2017/0001296 A1 Jan. 5, 2017

Related U.S. Application Data

(60) Provisional application No. 62/187,520, filed on Jul. 1, 2015.

(51) Int. Cl.

| | |
|---|---|
| ***B25G 1/00*** | (2006.01) |
| ***B25G 1/06*** | (2006.01) |
| ***B25G 3/38*** | (2006.01) |
| ***B05C 17/02*** | (2006.01) |
| ***A46B 5/02*** | (2006.01) |

(52) U.S. Cl.

CPC ..... *B25G 1/06* (2013.01); *A46B 5/021* (2013.01); *B05C 17/0205* (2013.01); *B25G 1/00* (2013.01); *B25G 3/38* (2013.01)

(58) Field of Classification Search

CPC . B25G 1/06; B25G 1/102; B25G 3/00; B25G 3/24; B25G 3/38; B25G 1/00; B25F 5/026; B62B 5/264

USPC ..... 16/419, 422, 426, 427, 430

See application file for complete search history.

(56) References Cited

U.S. PATENT DOCUMENTS

| | | | | | |
|---|---|---|---|---|---|
| 5,313,735 | A * | 5/1994 | Latouche | A01K 87/08 | 16/427 |
| 5,379,758 | A * | 1/1995 | Snyder | A61B 17/02 | 15/143.1 |
| 5,455,981 | A * | 10/1995 | Wiese | A47L 13/022 | 15/143.1 |
| 5,716,087 | A * | 2/1998 | Backich | A01B 1/02 | 16/422 |
| 5,809,614 | A * | 9/1998 | Kretser, Jr. | A01B 1/00 | 16/422 |
| 5,890,259 | A * | 4/1999 | Sarac | A01B 1/00 | 16/422 |
| 6,082,795 | A * | 7/2000 | Fornelli | A01B 1/00 | 16/422 |
| 6,464,272 | B1 * | 10/2002 | Michaud | A01B 1/026 | 16/430 |
| 6,598,266 | B1 * | 7/2003 | Elliott | A01B 1/00 | 16/426 |
| 6,698,064 | B1 * | 3/2004 | Graj | A47J 45/071 | 16/422 |
| 7,464,441 | B2 * | 12/2008 | Peach | B62B 1/18 | 16/430 |
| 7,637,882 | B2 * | 12/2009 | Carman, Jr. | A01B 1/00 | 16/422 |

(Continued)

OTHER PUBLICATIONS

Trentco Innoventions, Pro Handle Advertisement 2009, SKU #677-932.

*Primary Examiner* — Roberta S Delisle
(74) *Attorney, Agent, or Firm* — Z IP Law PLLC

(57) ABSTRACT

A versatile extension grip that may be affixed to a handle such as the handle of a broom, mop, shovel, paint roller, fruit picker or other type of tool. The versatile extension grip provides leverage, maneuverability and efficiency in using many different types of tools and provides for the tools to be manipulated using only one hand.

20 Claims, 15 Drawing Sheets

(56) References Cited

U.S. PATENT DOCUMENTS

| | | | | |
|---|---|---|---|---|
| 7,818,847 | B1 * | 10/2010 | Hermann | B25G 1/00 16/110.1 |
| 8,776,648 | B2 * | 7/2014 | Lee | B25G 1/102 16/426 |
| 8,973,200 | B2 * | 3/2015 | Mallett | A46B 5/00 15/143.1 |
| 2010/0005607 | A1 * | 1/2010 | DelaBarre | A46B 5/02 15/143.1 |

* cited by examiner

VERSATILE EXTENSION GRIP

RELATED PATENT APPLICATION

This application claims the benefit of U.S. Provisional Patent Application No. 62/187,520 filed Jul. 1, 2015 entitled VERSATILE EXTENSION GRIP which is hereby incorporated herein by reference in the entirety.

FIELD OF THE INVENTION

The present invention is related to a versatile extension grip that may be affixed to the handle of a broom, shovel, paint roller, fruit picker or other type of tool having a lengthy cylindrical, cubed, or rectangular shaped handle. The versatile extension grip provides leverage, maneuverability and efficiency in using many different types of tools and provides for the tools to be manipulated using one hand.

BACKGROUND OF THE INVENTION

Brooms, shovels, paint rollers and other hand tools that have long shaft shaped handles may require gripping of the handle with one or both hands in an awkward manner to drag or pull the base of the tool, reach with the tool or lift with the tool. When further holding a second item such as a dustpan with a broom the user must unnaturally grasp around the handle using a large portion of their arm to gain leverage to maintain the brushes of the broom to the ground to collect and sweep dirt into the dustpan. Similarly, when shoveling, the handle must be awkwardly held and supported along the handle by placing the arm underneath the handle to lift something heavy such as rocks, wet snow, or well packed earth to provide the strength to force the scoop of the shovel upward and maneuver the heavy object to another location. Maneuverability of the handle and leverage may further be required when directing a long handled object over a person's head and into the air to for example to pull a broom or mop to clean, dust, or maneuver a paint roller along a ceiling or upper area of a wall or to pull a piece of fruit from a high limb on a tree. The awkwardness of dragging, lifting and pulling may be taxing and when performed repeatedly may cause soreness or aches in muscles not normally used. The versatile extension grip of the present invention provides an ergonomic solution that reduces awkwardness and provides for a tool to be manipulated using only one hand.

SUMMARY OF THE INVENTION

The present invention provides a uniquely, versatile extension grip that may be affixed to the handle of a tool or other implement that provides increased leverage and maneuverability of the tool improving the efficiency and ease of use in using the tool. The handle of the tool may be cylindrical, cubed or rectangular in shape and may have an extended length such as the handle of a broom or mop. The extension grip of the present invention may comprise one or more hand grips, an attachment fixture to affix the extension grip to the handle of a tool and an arm support brace to provide leverage and allow the tool to be more easily maneuvered even using only one hand. The extension grip may be attached in either direction to pull the tool towards the user's body, extend the tool in the air to reach and maneuver the tool for example over the person's head, or push the tool away from the user. In using the tool in various ways, the user may insert their arm through the support brace with either the front or the rear surface of their forearm against the brace and grasp the hand grip in their hand to pull, lift, and/or push the head of the tool.

The hand grip has an extended bar for the user to hold on to and frame supports that attach the extended bar to an attachment fixture to affix the hand grip to the handle of the tool. The extended bar may be of any thickness and dimension to accommodate a person's hand. The extended bar may be positioned perpendicular to and at a distance from the handle or may extend around the handle in a circular shape. The support brace may also have a brace portion formed in a partial circular shape with a curvature to comfortably accommodate a user's arm. The support brace is attached to an attachment fixture using extension supports. In various embodiments, the extension grip of the present invention may have the hand grip and the arm support brace attached at a single attachment point using one attachment fixture positioned along the shaft of the handle. In other embodiments, two attachment fixtures may be used for the attachment with one for the hand grip and one for the support brace. The hand grip and support brace may each be pivotally attached to the attachment fixture so that the distance from either the hand grip in relation to the handle or the support brace in relation to the handle may be adjusted to accommodate the width and length of a person's arm.

The extension grip may be permanently or removably attached to the handle with either attachment providing for the attachment fixture to slide along the handle to adjust to the height of the user. The attachment fixture may have a compression clip, screws, nuts, bolts, or other fasteners. In an embodiment, a compression clip may be compressed to be opened and then be closed or snapped on around the handle or be otherwise affixed to the shaft of the handle. Upon completion of a task using the tool, the extension grip may be removed from the handle or be slid out of the way so the tool may still be used without the extension grip. The extension grip may be used with a broom, a mop, a shovel, a paint roller or other tools and in some embodiments, the extension grip may be manufactured with the tool or other implement to be permanently or adjustably affixed to the handle.

The utility of the present invention is provided where the user may insert their arm and grasp the hand grip with the upper surface of their arm against the handle and the lower surface of their arm against the arm support brace. In this manner, the hand grip and arm support brace provides for a pulling motion of the tool for example to sweep using one hand and direct debris into a dustpan. The arm support brace provides the leverage needed against the arm and allows for a natural motion of pulling the arm towards the body which is very different from twisting the arm around the handle and trying to use the handle for leverage while holding the handle to push the broom brushes or bristles to the floor to sweep and direct debris into a dustpan. The leverage provided with the arm support brace of the extension grip may further provide for the tool to be extended over the head of the user and be pushed away from the user to remove dust or debris from an upper surface such as a ceiling, ceiling fan, the upper portion of a wall or window. When leveraging a tool over the head of a user or in other instances, the user may insert their arm between the arm support brace and the handle and grasp the hand grip with the lower surface of their arm against the handle to provide leverage in pushing the tool along a surface, such as in using a paint roller along the surface of a ceiling or wall. The extension grip may also be pulled down towards or across a user to maneuver and negotiate a tool such as a fruit picker to pull fruit from a tree.

The present invention is related to a versatile extension grip comprising a hand grip and a support brace and wherein the hand grip and support brace are attached to the handle of a tool to more easily maneuver the tool.

The present invention is also related to a broom handle extension grip comprising a hand grip, a support brace, and at least one attachment fixture, and wherein the at least one attachment fixture is attached to the handle of a broom to maneuver the broom with one hand to direct debris into a dust pan.

The present invention is also related to a paint roller extension grip comprising a hand grip, a support brace, and at least one attachment fixture, and wherein the at least one attachment fixture is attached to the handle of a paint roller to more easily maneuver the paint roller along the surface of a wall, floor or ceiling.

The present invention is also related to a shovel extension grip comprising a hand grip, a support brace, and at least one attachment fixture, and wherein the at least one attachment fixture is attached to the handle of a shovel to more easily lift heavy objects.

The present invention is also related to an extension grip, comprising a support brace; a hand grip; and wherein the support brace and handgrip are attached to the handle of a tool to provide leverage and maneuverability. The extension grip may have the support brace pivotally attached to the handle of the tool. The extension grip may have the hand grip pivotally attached to the handle of the tool. The extension grip may be removably attached to the handle of the tool. The extension grip may be permanently attached to the handle of the tool. The extension grip may slide along the handle of the tool. The tool that has the extension grip attached to it may be a broom, a mop, a paint roller, a fruit picker, a shovel, or other implement. The extension grip may comprise at least one attachment fixture to secure the support brace and hand grip to the handle of the tool. The attachment fixture of the extension grip may comprise at least one semicircular opening for the adjustment of an angle between the handle of the tool and the support brace. The attachment fixture of the extension grip may comprise at least one semicircular opening for the adjustment of an angle between the handle of the tool and the hand grip. The attachment fixture of the extension grip may comprise at least one cross shaped opening for the adjustment of an angle between the handle of the tool and the support brace. The attachment fixture of the extension grip may comprise at least one cross shaped opening for the adjustment of an angle between the handle of the tool and the hand grip. The attachment fixture of the extension grip may comprise a cylindrical body, extension tab, and flanges. The support brace of the extension grip may comprise a curved brace portion. The hand grip of the extension grip may comprise a cushioned grip.

The present invention is further related to a method of providing leverage and maneuverability to a tool comprising the steps of affixing a support brace to the handle of a tool, affixing a hand grip to the handle of a tool, inserting a hand through the support brace to grasp the hand grip to gain added leverage and more easily maneuver the tool. The method of providing leverage and maneuverability to a tool may comprise the step of pivotally attaching the support brace and hand grip to the tool to provide for adjustment to accommodate the length and size of a user's hand and arm.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE INVENTION

Figure 1:
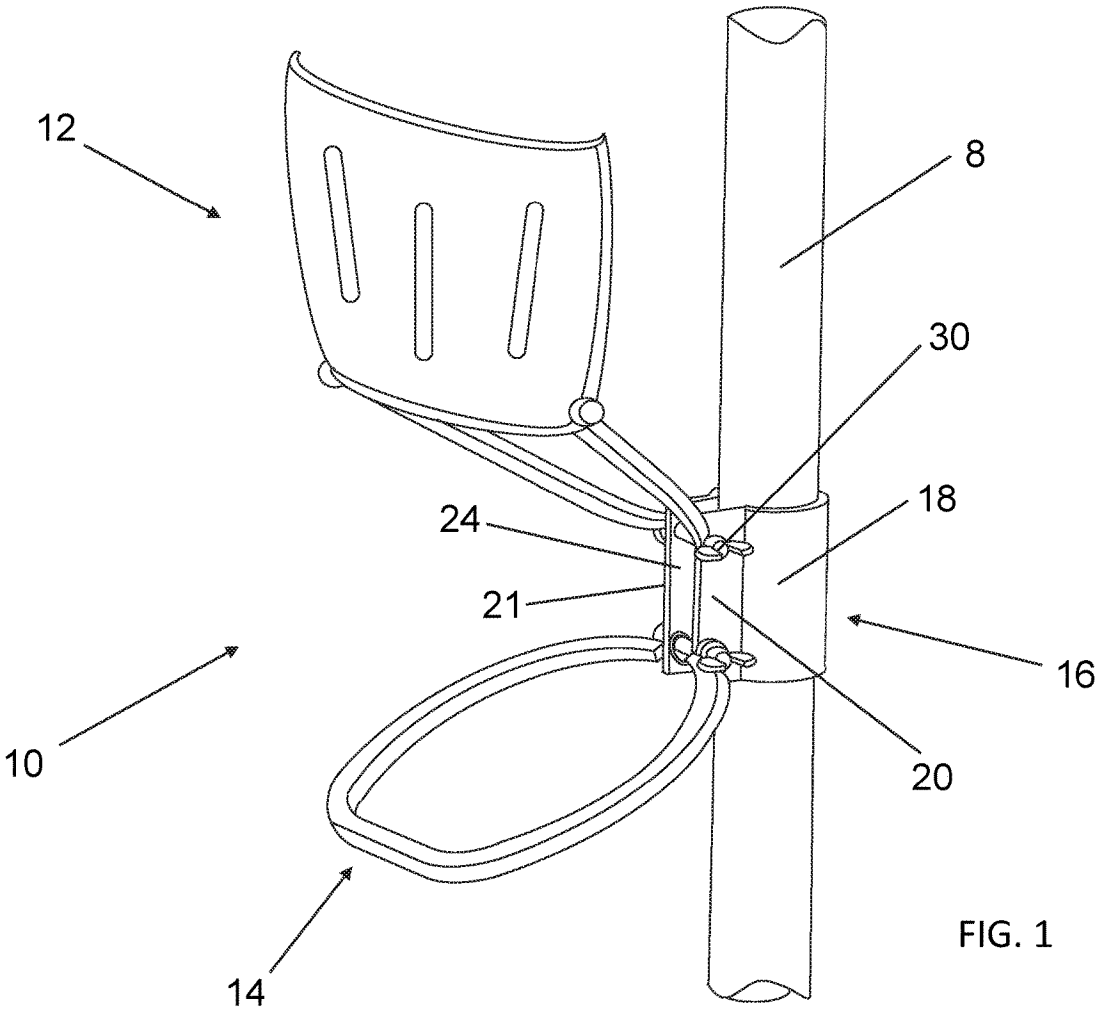
FIG. 1 is a perspective view of an embodiment of the versatile extension grip of the present invention attached to the handle of a tool.
Figure 2:
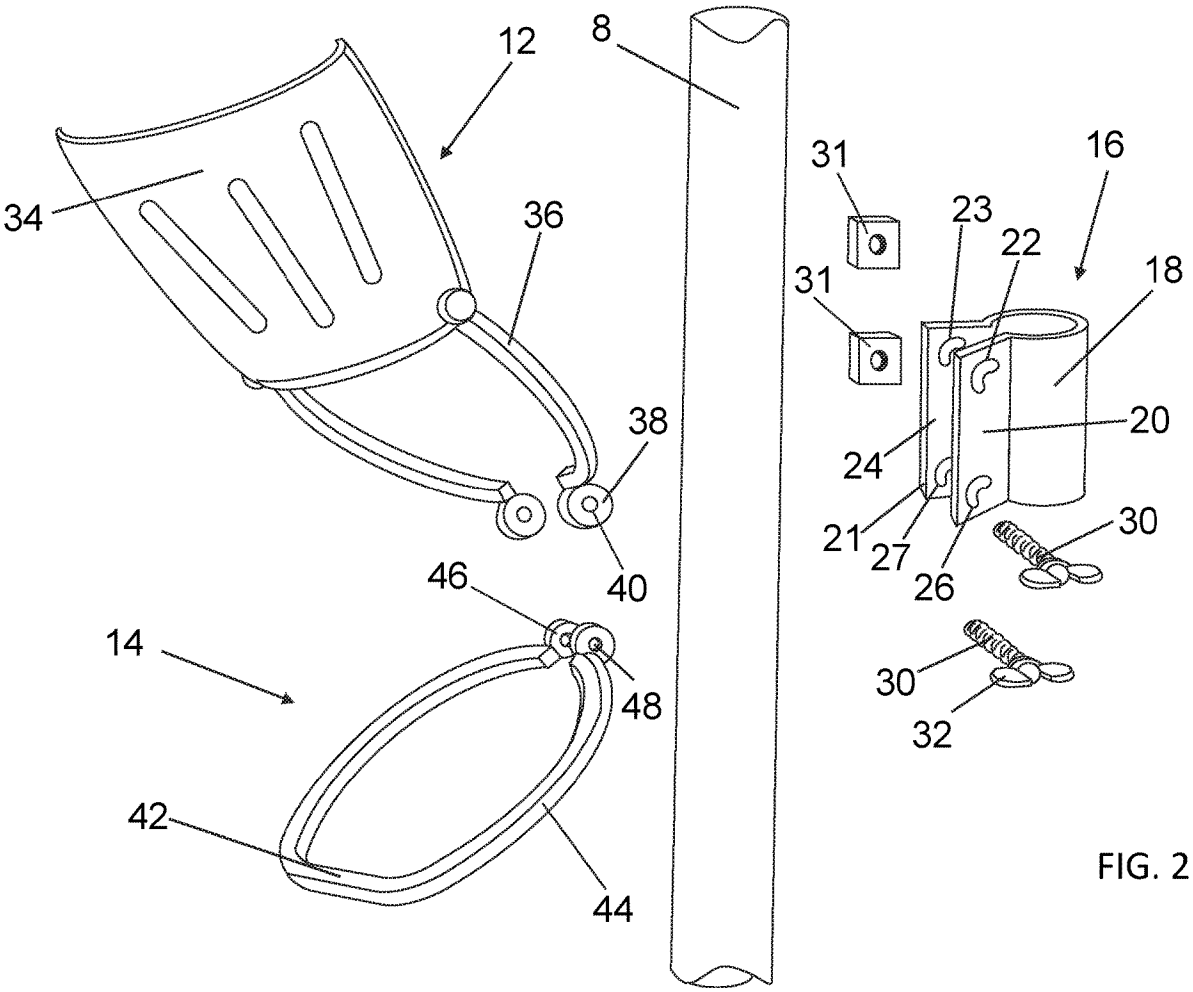
FIG. 2 is an exploded view of an embodiment of the versatile extension grip of the present invention with the handle of a tool.

A shown in FIG. 1, the versatile extension grip 10 of the present invention includes an arm support brace 12, a hand grip 14 and an attachment fixture 16. In a first embodiment, the attachment fixture may be formed having a cylindrical body 18 that partially surrounds the handle 8 of a tool. Extending from each edge of the cylindrical body 18 of the attachment fixture 16 is a first tab 20 and a second tab 21. As shown in FIG. 2, an inner surface 24 of the first tab 20 of the attachment fixture 16 may align with the inner surface 24 of the second tab 21 and a bolt 30 is inserted through the opening 22 and is secured with a nut 31 to draw the two tabs 20 and 21 close together to near to a point of touching or to a point of touching to secure the attachment fixture 16 to the handle 8. The bolts 30 may have wings 32 or other type grips so that the bolt 30 may be easily hand tightened without using a wrench or any other tools. In some embodiments, the tabs 20 and 21 of the attachment fixture 16 also provide for the attachment of the arm support brace 12 and the hand grip 14 to the handle 8.

The arm support brace 12 may be formed with a curved brace region 34 that extends from or is attached to semi-circular support extensions 36. Each end of the semi-circular support extensions 36 may have a flange 38 that has an opening 40. To attach the arm support brace 12, the wing bolt 30 or other hardware or fastener may be inserted through an upper opening 22 in the first tab 20 of the attachment fixture 16 and be inserted through the openings 40 in each of the flanges 38 of the arm support brace 12. The wing bolt 30 is then inserted through the opening 23 in the second tab 21. The wing bolt 30 is then inserted into a nut 31 and hand tightened so that the first tab 20 and second tab 21 are brought close together to tighten the cylindrical body 18 around the handle 8 to secure both the attachment fixture 16 and the arm support brace 12 to the handle 8. Similarly, the hand grip 14 may be formed with an extended bar 42 and a semicircular loop 44 having a flange 46 with an opening 48 on each end. The hand grip 14 is attached to the attachment fixture 16 using a second opening 26 in the first tab 20. A second wing bolt 30 is inserted through the lower opening 26 in the first tab 20, through the openings 48 in the flanges 46 of the hand grip 14 and through a second opening 27 in the second tab 21 of the attachment fixture 16. The second wing bolt 30 is hand tightened using a second nut 31 or other fastener. In further embodiments, the openings 23 and 27 may be threaded to tighten and secure the wing bolt 30 so that a separate nut 31 is not required.

Figure 3:
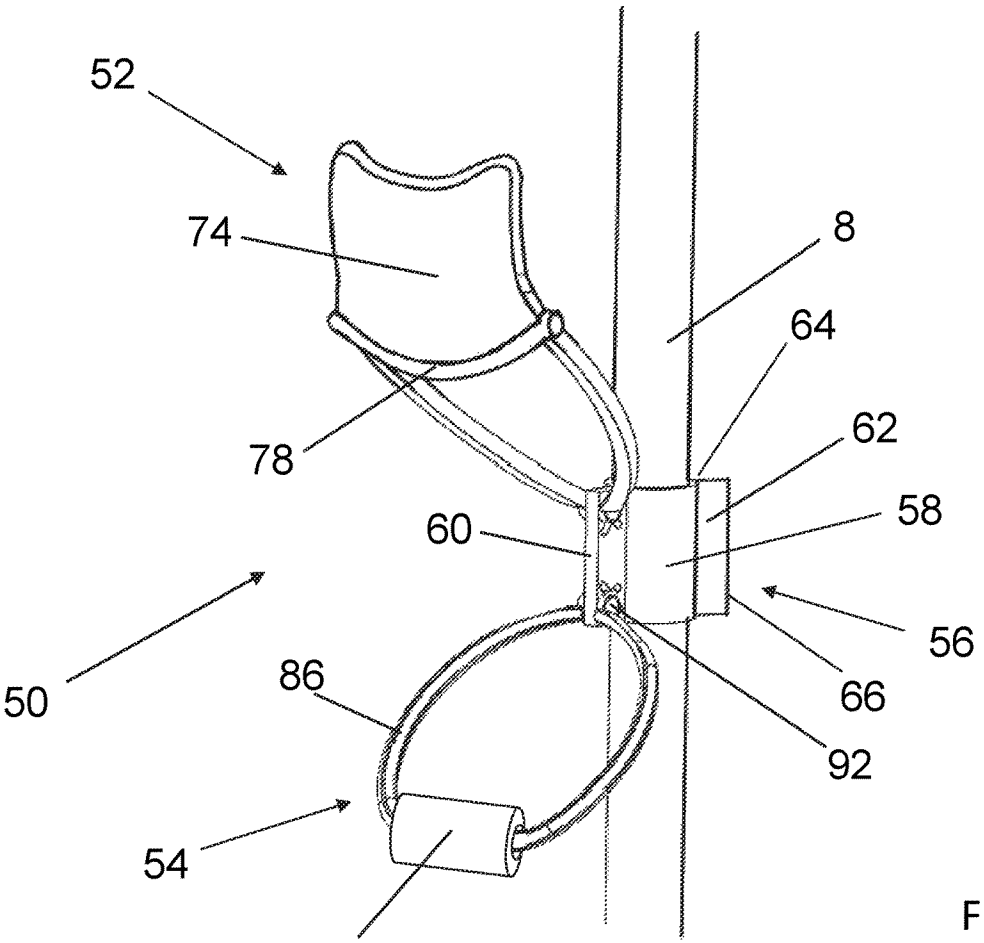
FIG. 3 is a perspective view of a further embodiment of the versatile extension grip of the present invention attached to the handle of a tool.
Figure 4:
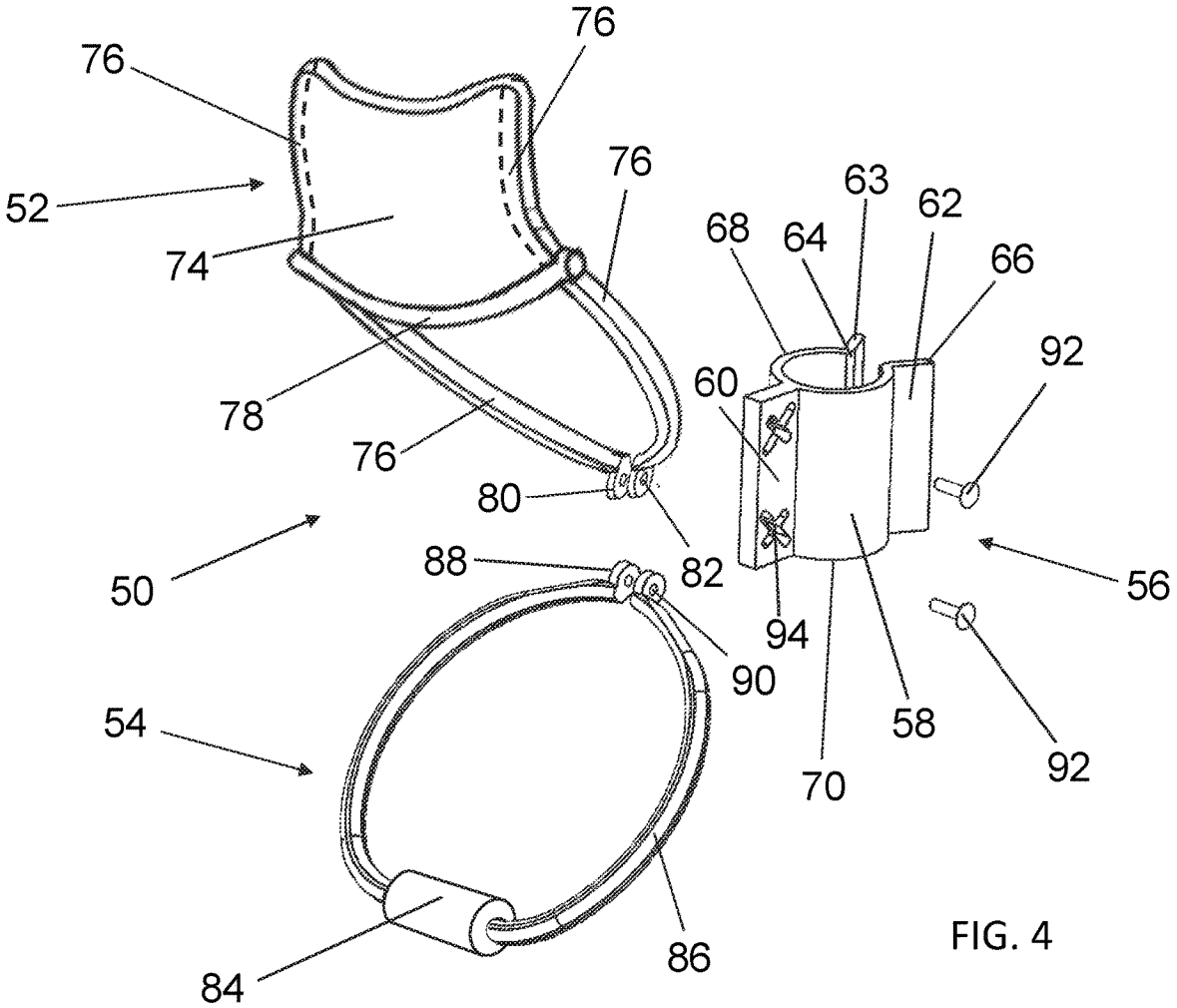
FIG. 4 is an exploded view of the embodiment shown in FIG. 3 of the versatile extension grip of the present invention.

In a further embodiment of the versatile extension grip 50 as shown in FIG. 3, the support brace 52 and hand grip 54 is attached to an extended surface 60 that extends from a central portion of the cylindrical body 58 of the attachment fixture 56. As shown in FIG. 4 on each opposing end of the cylindrical body 58, a first tab 62 and a second tab 63 are formed. In this manner the cylindrical body 58 and tabs 62 and 63 are formed with sufficient spring tension to draw a base portion 64 of the flanges 62 together while a flared portion 66, best shown in FIG. 4, provides a widened opening to press and force the attachment fixture 56 onto the handle 8. The attachment fixture 56 is secured by the spring tension to form a compression fit around the handle 8. The spring tension may be of sufficient force and the diameter of the cylindrical portion 58 may be adequately dimensioned to hold the attachment fixture 58 in a single position on the handle 8 or provide enough tolerance to allow for the attachment fixture 56 to be slid along the handle 8 when enough force is applied to the upper surface 68 or to lower surface 70 of the cylindrical body 58 to push or pull the attachment fixture 56 along the handle 8.

The curved brace region 74 may be formed of a pliable material such as a soft plastic or of a fabric suspended over side frame pieces 76 or other support fixtures. A rigid curved base frame piece 78 may be pivotally or rigidly connected along a portion of the side frames 76 to provide support against the user's arm with the brace region 74 of soft plastic or fabric providing a cushion to comfortably support the arm when using the tool. The side frame pieces 76 may extend and curve with flanges 80 having openings 82 being formed at the end of each frame piece 76 for attachment of the support brace 52 to the attachment fixture 56.

Figure 5:
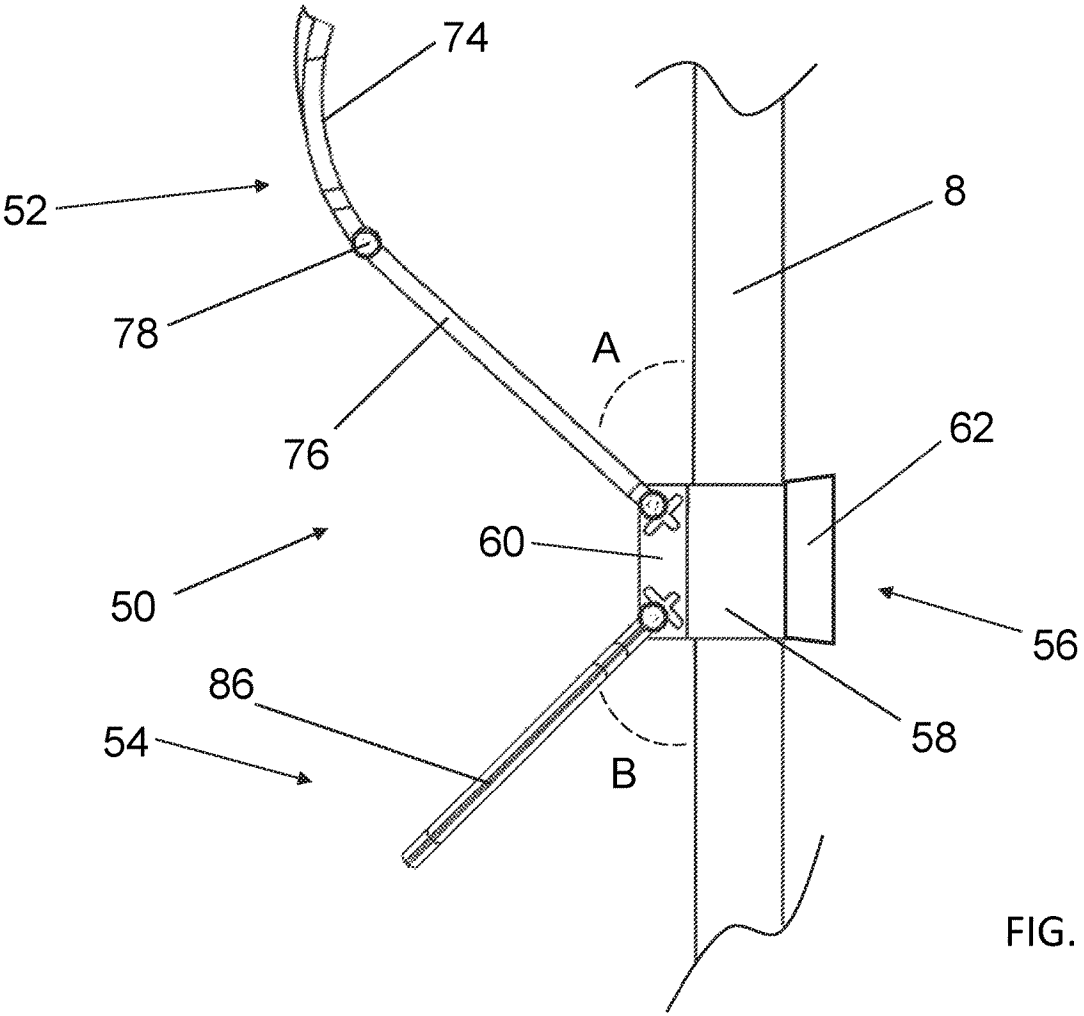
FIG. 5 is a side view of the embodiment shown in FIG. 3 of the versatile extension grip of the present invention attached to the handle of a tool.

The hand grip 54 may also have a cushioned grip 84 for comfort and a frame piece 86 that curves and has flanges 88 formed with openings 90 for the attachment of the hand grip 54 to the attachment fixture 56. The support brace 52 and hand grip 54 may be attached to the attachment fixture 56 using one or more rivets 92 to form a permanent attachment. In an embodiment, the rivets 92 may be closely dimensioned to the openings 94 of the extended surface 60 of the attachment fixture 56 and to the openings 82 and 90 through the flanges 80 and 88 of the support brace 52 and hand grip 54. By closely dimensioning the rivets 92 to the openings, the support brace 52 and hand grip 54 are rigidly attached and may be positioned at a specific angle A for the support brace 52 and specific angle B for the hand grip 54 to accommodate different arm lengths and widths of users manipulating a tool using the versatile extension grip 50, as shown in FIG. 5. The openings in the attachment fixture may also be shaped in various ways to provide for adjustment of the angles A or B to properly space the support brace at an adequate distance from the handle 8 and position the hand grip 54 to allow the user to comfortably hold and manipulate the tool.

Figure 7:
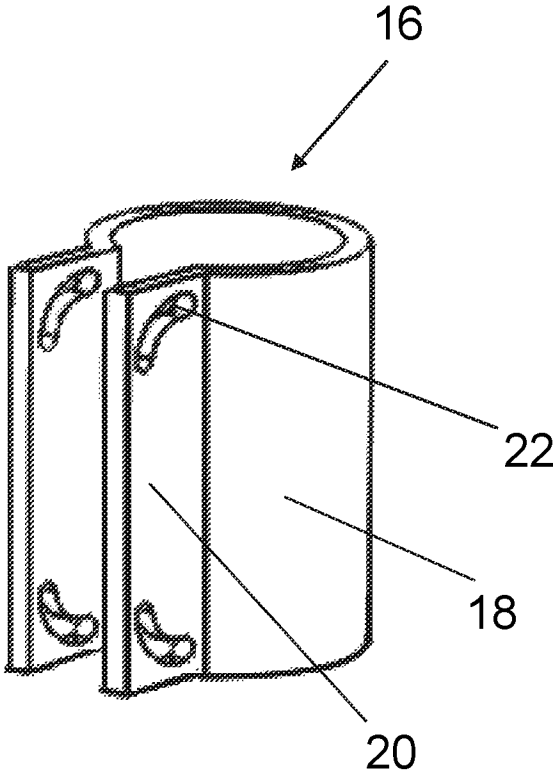
FIG. 7 is a perspective view of an embodiment of an attachment fixture in the embodiment shown in FIG. 1 of the versatile extension grip of the present invention.
Figure 6:
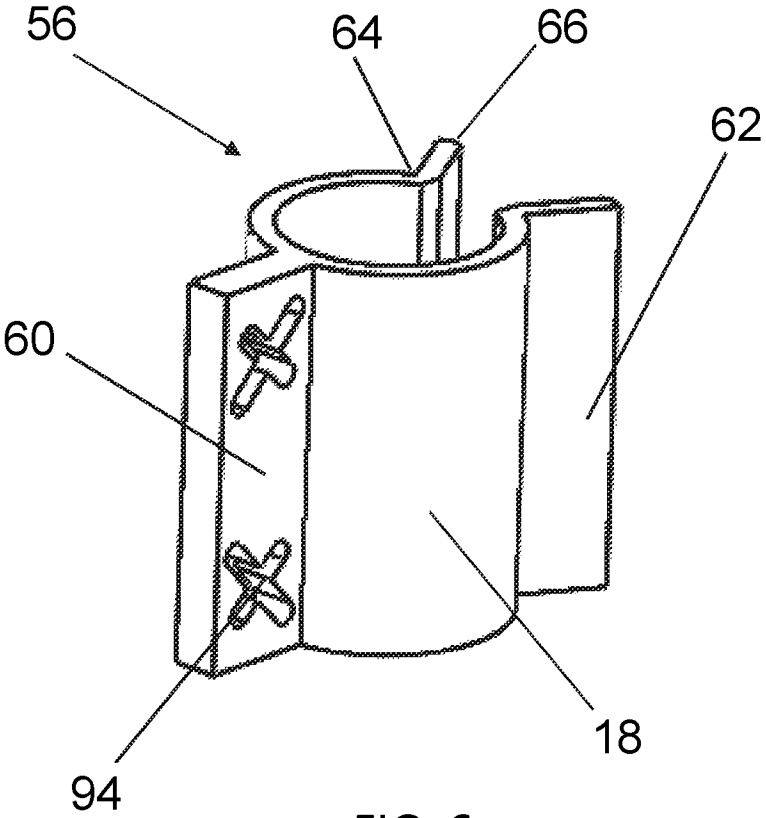
FIG. 6 is a perspective view of an embodiment of the attachment fixture in the embodiment shown in FIG. 3 of the versatile extension grip of the present invention.

As shown in FIG. 6, in an embodiment of the attachment fixture 56, the openings in the extended surface 60 may be of any shape such as oval, arced, semicircular or crossed openings. For example, using a tightly dimensioned rivet 92 or other attachment hardware, the shape of a cross as shown provides for the support brace 52 to be pulled in any one of four directions and to be secured in place at a specific angle A. In this manner a user can properly adjust the space between the handle 8 and the support brace 52 to provide for the user to easily insert their arm through the frame piece 76 and curved base frame piece 78 of the support brace 52 and rest or push their arm against the curved brace region 74 for leverage to properly manipulate the tool without having the support brace 52 move against the weight of the user's arm. The opening for the hand grip 54 may have a similar cross shape to provide for a proper distance with respect to the user's hand so that the hand of the user can comfortably grasp the hand grip 54 while supporting their arm against the brace region 74 of the support brace 52. In further embodiments, the opening 22 on the tab 20 of the attachment fixture 16, as shown in FIG. 7, may have a curved shape to provide for the wing bolt 30 to be slid within the opening 22 and be tightened at whatever point is appropriate for the user to support their arm against the support brace 12 for leverage and grasp the extended bar 42 of the hand grip 14 without having the curved brace region 34 move under the weight of the person's arm. In this manner various embodiments of the versatile extension grip 10 and 50 will accommodate the length and width of the arm of a user and be easily adjusted as necessary to accommodate for another user having a longer or shorter arm to use the versatile extension grip 10 and 50.

Figure 8:
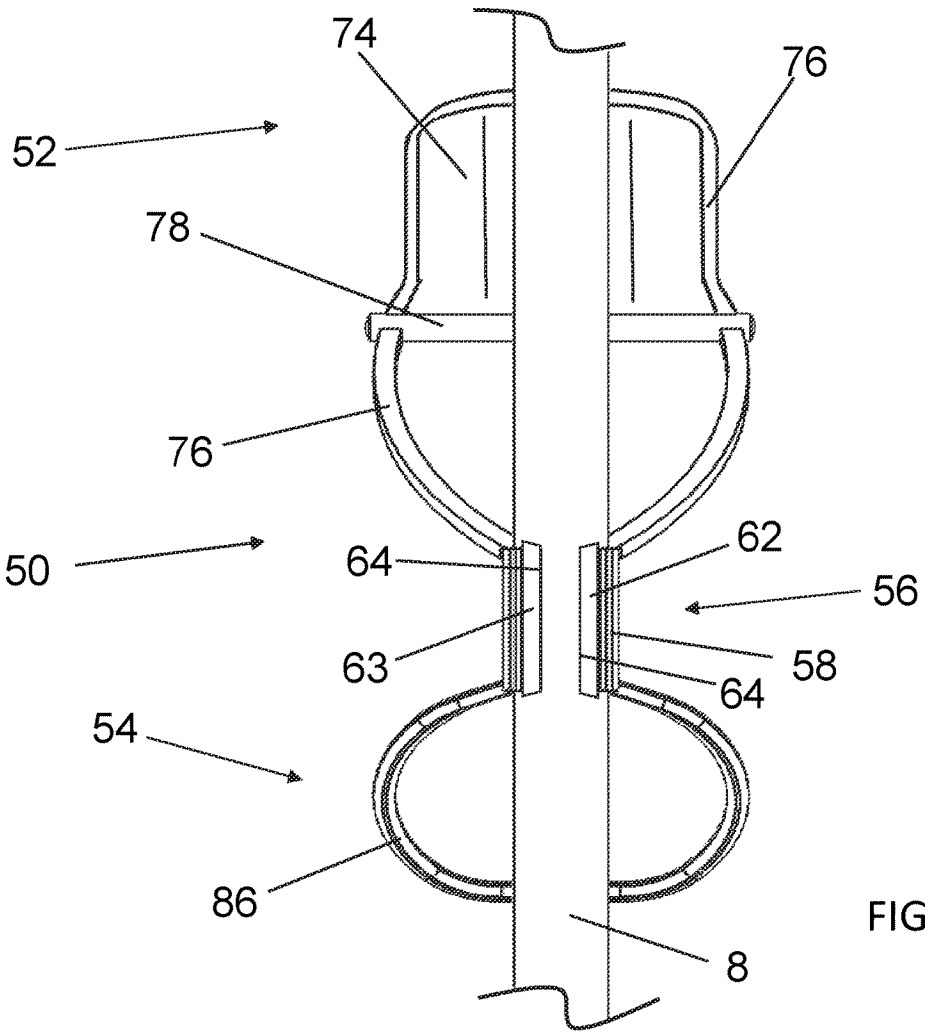
FIG. 8 is a rear view of the embodiment shown in FIG. 3 of the versatile extension grip of the present invention attached to the handle of a tool.

The versatile extension grip 10 and 50 may be manufactured from molded plastic, coated wire, metal, wood or other structurally adequate materials to provide for a user to support and more easily manipulate the tool. For example, as shown in a rear view in FIG. 8, a plastic snap fit joint may form a compression fit to hold the extension grip 50 in place along the handle 8. A user may simply grasp the extension grip 50 between the support brace 52 and hand grip 54 and press the opening in the cylindrical body 58 against the handle 8 to force the flanges 62 to separate. The cylindrical body 58 has adequate spring tension to provide for the base portion 64 of each flange to draw together and securely hold the attachment fixture 56 of the extension grip 50 in place along the handle 8. The compression fit provides for the versatile extension grip 50 to be used on a range of different tools having shaft sizes of different materials, shapes, and diameters. The spring tension of the snap fit joint of the cylindrical body 58 is adequate to securely hold the extension grip 50 in place while the user manipulates the tool, but may also provide for a small amount of force to be applied to slide the extension grip along the handle 8 and out of the way so that the tool may be used normally. The compression fit may further be secure enough to hold the extension grip 50 when in use and then be easily removed from the tool to be stored away or to be easily slid onto another tool.

Figure 9:
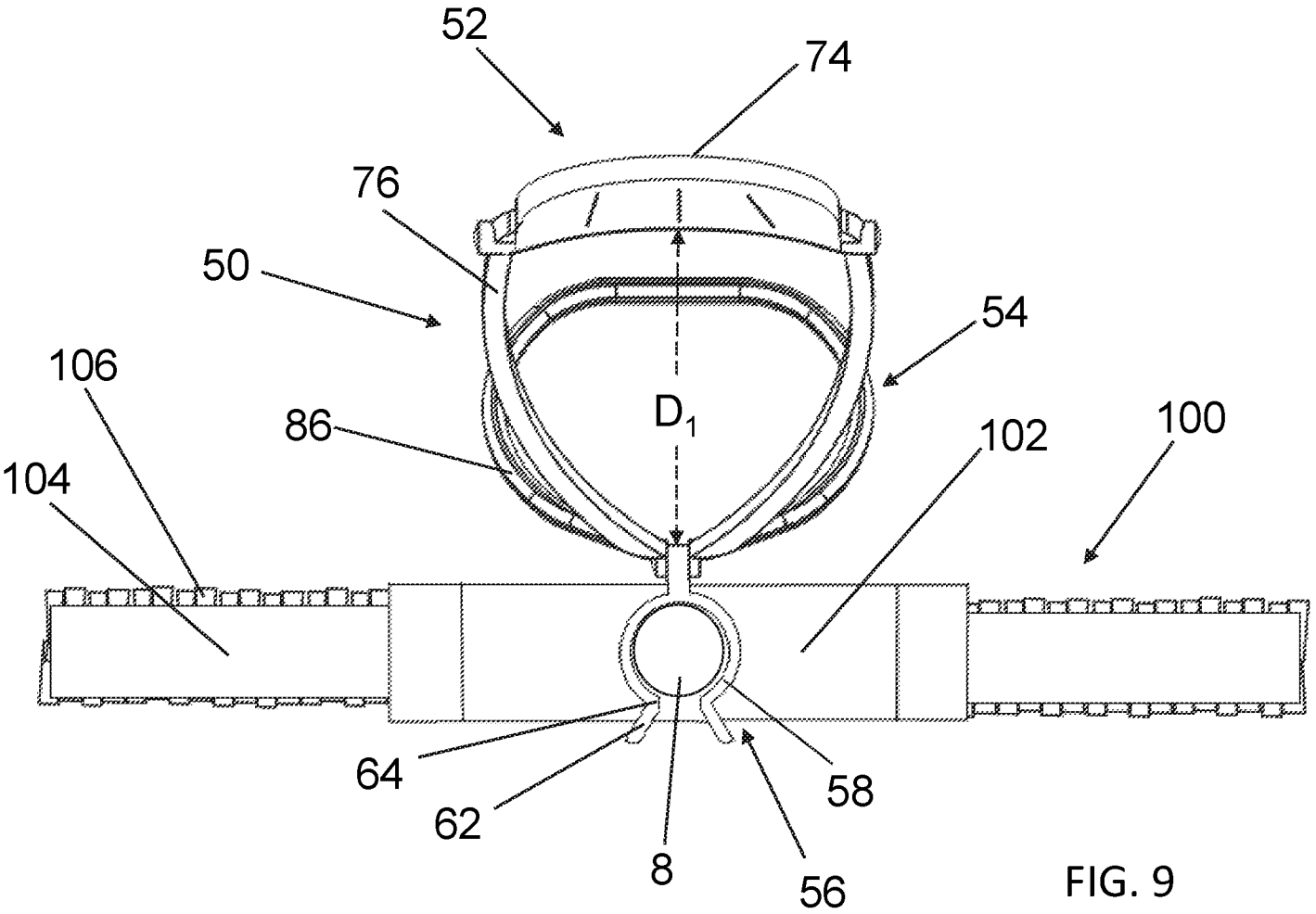
FIG. 9 is a top view of an embodiment of the versatile extension grip of the present invention attached to the handle of a broom.

The versatile extension grip 10 and 50 in various embodiments may be used with a number of different tools. A top view of the attachment of the extension grip 50 to a broom 100 is shown in FIG. 9. The extension grip 50 is secured along the handle 8 above the connector 102 and broom body 104 providing for a user to slide their arm through the area between the handle 8 and the support brace 52 and reach to grasp the hand grip 54. The distance $D_1$ between the handle 8 and the support brace 52 can be adjusted by moving the rivet 92 into another portion of the cross opening 94 or by pivoting the support brace 52 to adjust the angle A to provide for the user's arm to more comfortably rest or brace against on or within the curved brace region 74. In other embodiments, the wing bolt 30 may be loosened and adjusted to a different position within the openings 22 and 23 of the first tab 20 and second tab 21, and then tightening the wing bolt 30.

Figure 10:
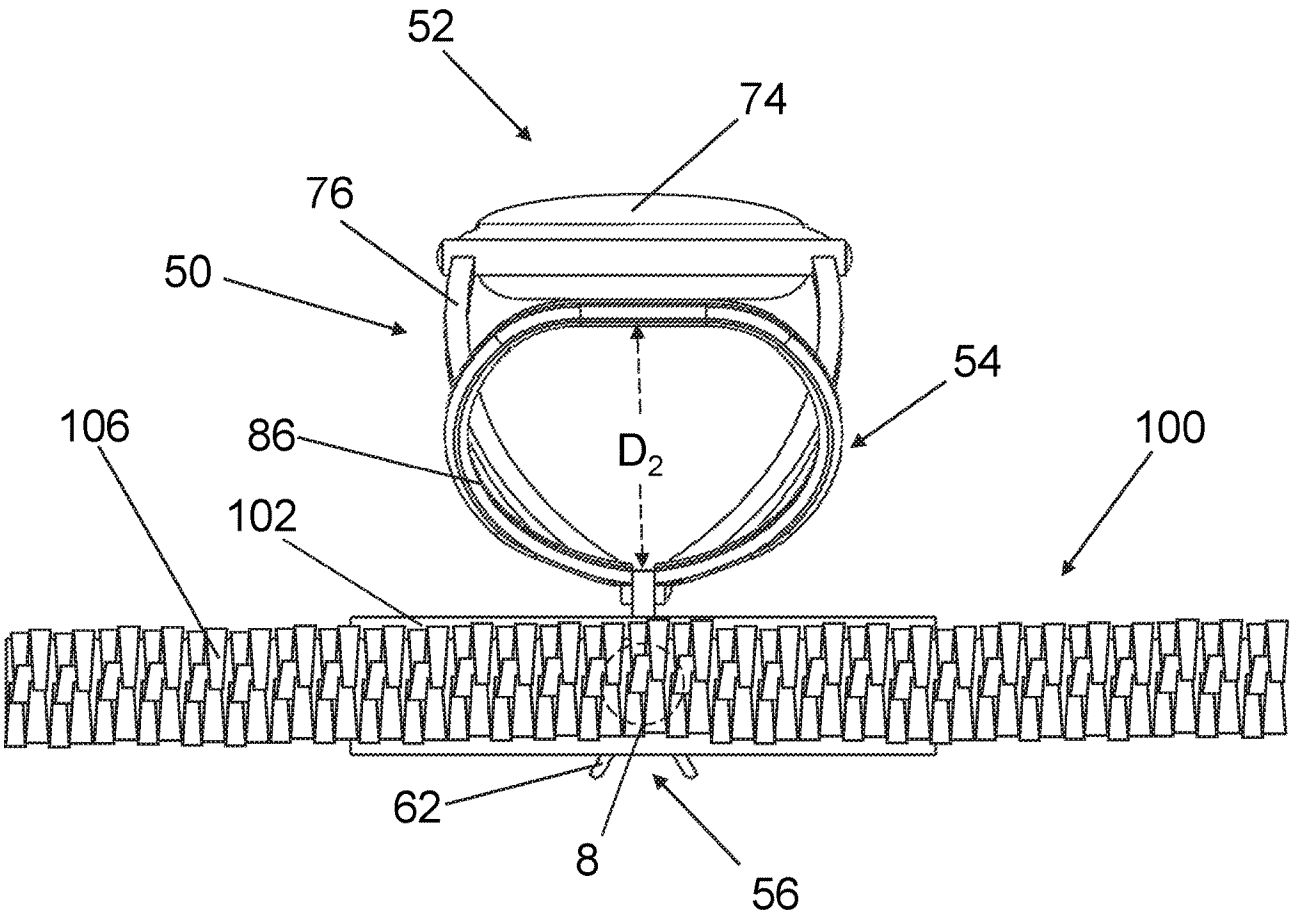
FIG. 10 is a bottom view of an embodiment of the versatile extension grip of the present invention to the handle of a broom.

The distance $D_2$ between the hand grip 54 and the handle 8 as shown in FIG. 10, may be similarly adjusted by repositioning the rivet 92 or other hardware within the opening of the attachment fixture 56 or by pivoting to adjust the angle B between the handle 8 and the hand grip 54. Close tolerances of various attachment hardware to the attachment fixture openings may be provided in order to once positioned, hold and maintain the support brace 52 and hand grip 54 at the proper distance and angle best suited for the user to manipulate the tool. For example, once the extension grip 50 is properly adjusted, the bristles 106 of the broom 100 may be held firmly to the ground using only one hand to easily sweep debris into a dustpan that is held by the other hand of the user.

Figure 11:
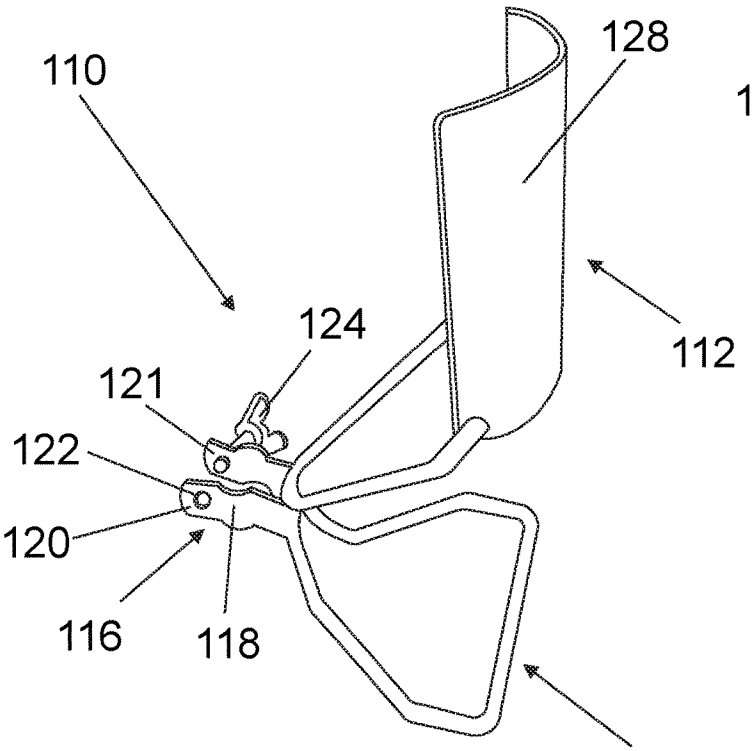
FIG. 11 is a left perspective view of an embodiment of the versatile extension grip of the present invention.

In a further embodiment as shown in FIG. 11, the versatile extension grip 110 may have an attachment fixture 116 that has a single connection point for the hand grip 114 and the arm support brace 112 with a preset distance between the support brace 112 and handle 8 and between the hand grip 114 and the handle 8. The attachment fixture 116 may be formed similar to a clamp ring with a cylindrical portion 118 and extension tabs 120 and 121. One extension tab 120 may have an opening 122 and the other extension tab 121 may have a captive wing bolt 124, screw or other hardware. The captive wing bolt 124 may be loosened to be nearly flush with the extension tab 121 to provide for the handle 8 to be inserted between the extension tabs 120 and 121 to be positioned in the cylindrical portion 118 of the attachment fixture 116. The captive wing bolt 124 may be extended through the opening 122 of the extension tab 120 and be tightened to secure the versatile extension grip 110 in place along the handle 8. Other mechanisms for the attachment of the versatile extension grip 110 to the handle 8 are within the scope of the present invention.

Figure 12:
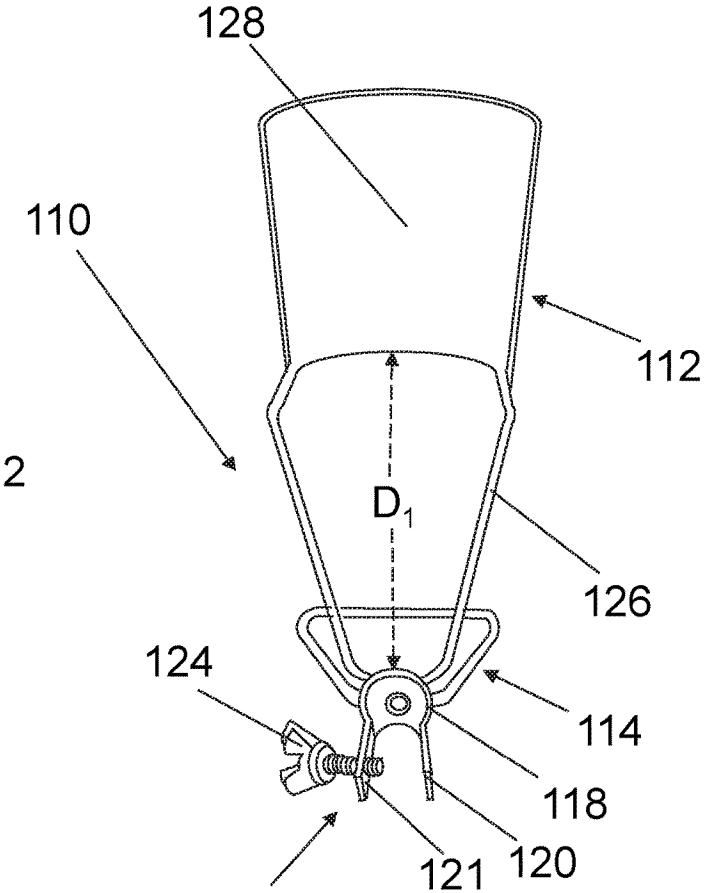
FIG. 12 is a rear view of an embodiment of the versatile extension grip of the present invention.
Figure 14:
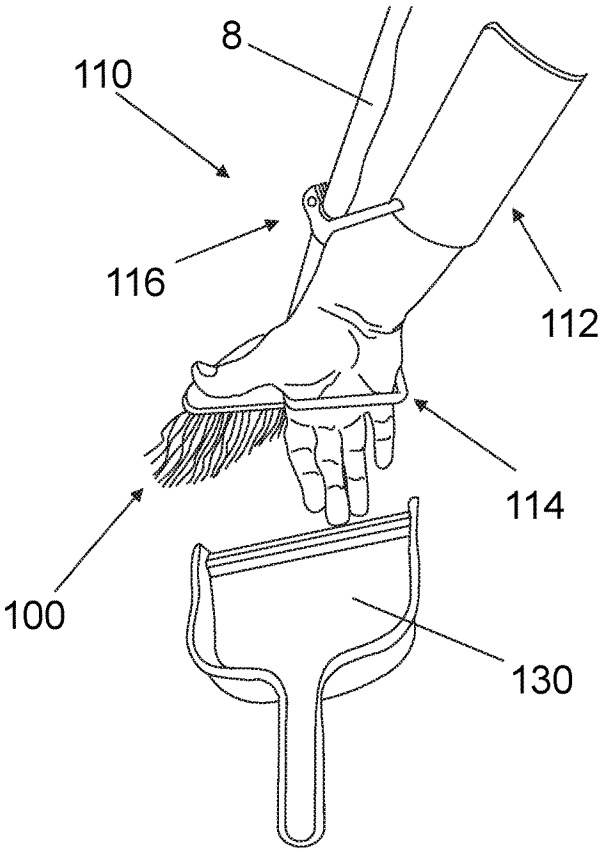
FIG. 14 is a front perspective view of an embodiment of the versatile extension grip of the present invention affixed to a broom with a dust pan.
Figure 13:
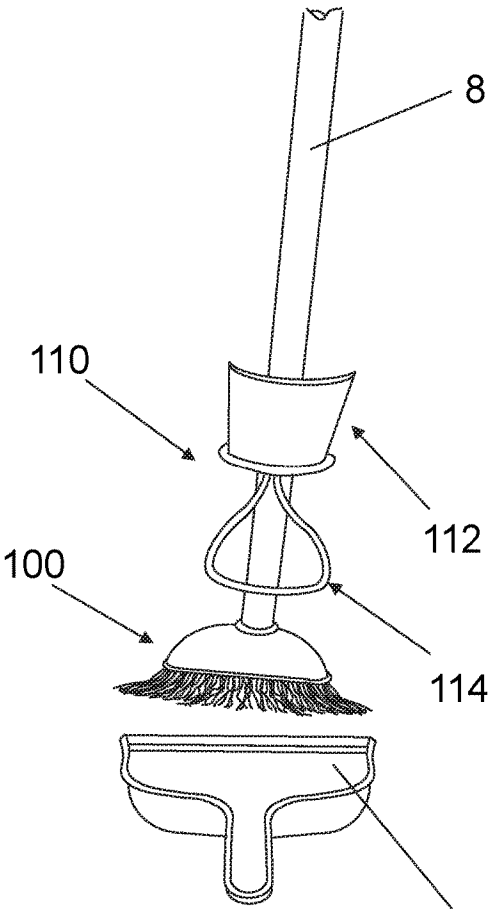
FIG. 13 is a front view of an embodiment of the versatile extension grip of the present invention affixed to a broom with a dust pan.
Figure 16:
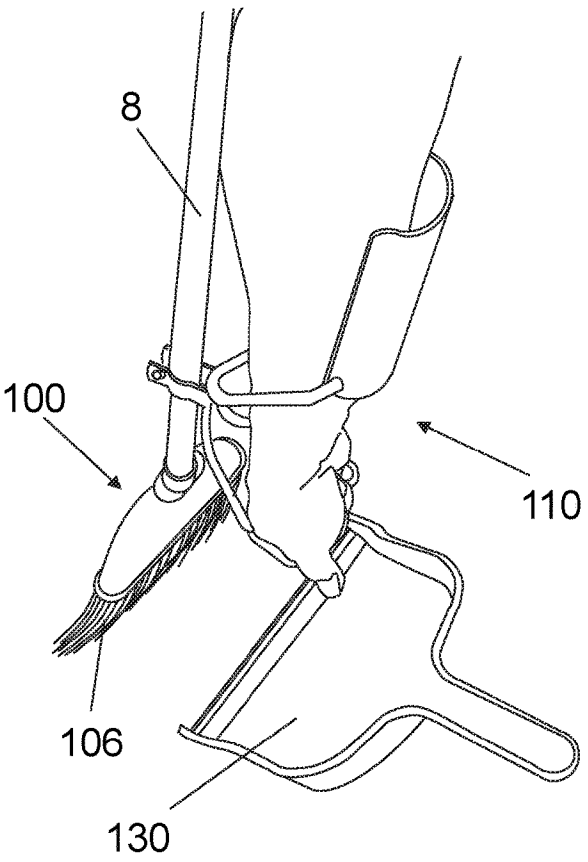
FIG. 16 is a side perspective view of an embodiment of the versatile extension grip of the present invention affixed to a broom with a dust pan.
Figure 15:
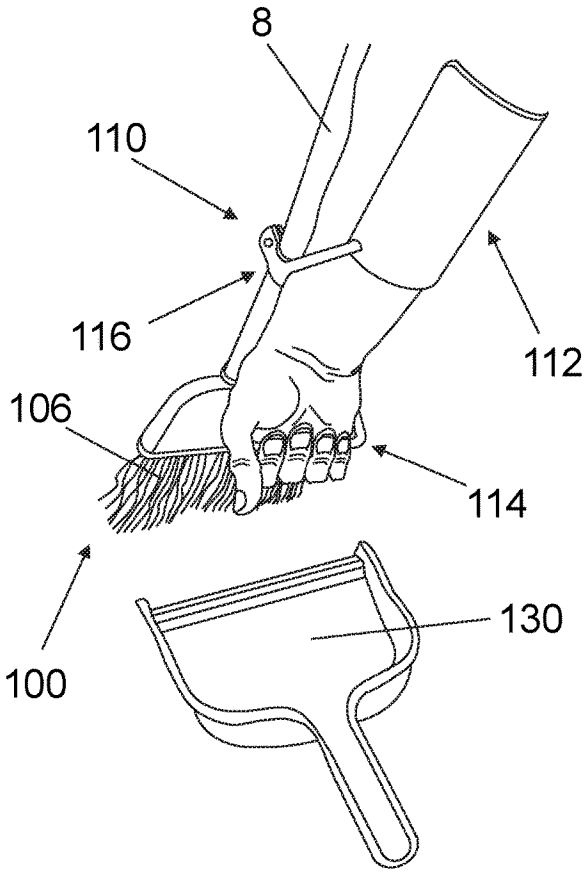
FIG. 15 is a front perspective view of an embodiment of the versatile extension grip of the present invention affixed to a broom with a dust pan.
Figure 18:
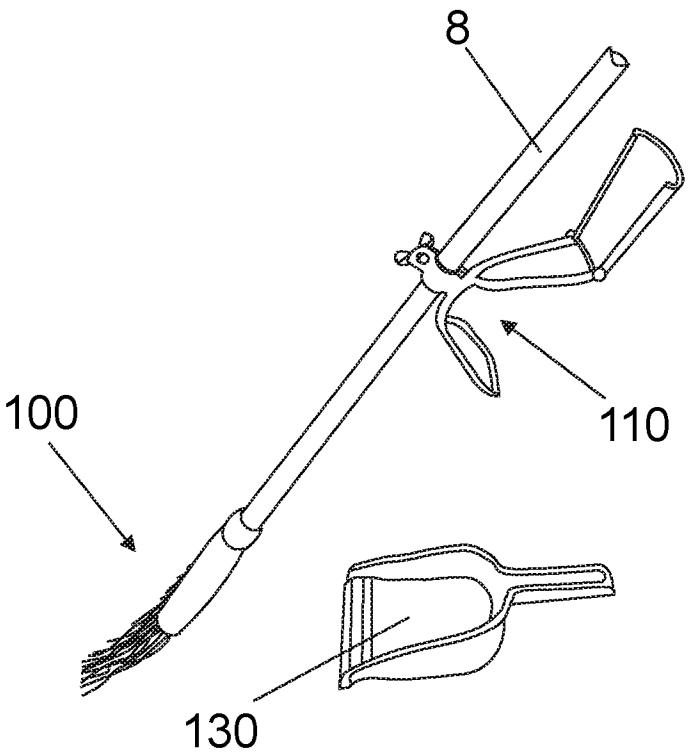
FIG. 18 is a side view of an embodiment of the versatile extension grip of the present invention affixed to a broom with a dust pan.
Figure 17:
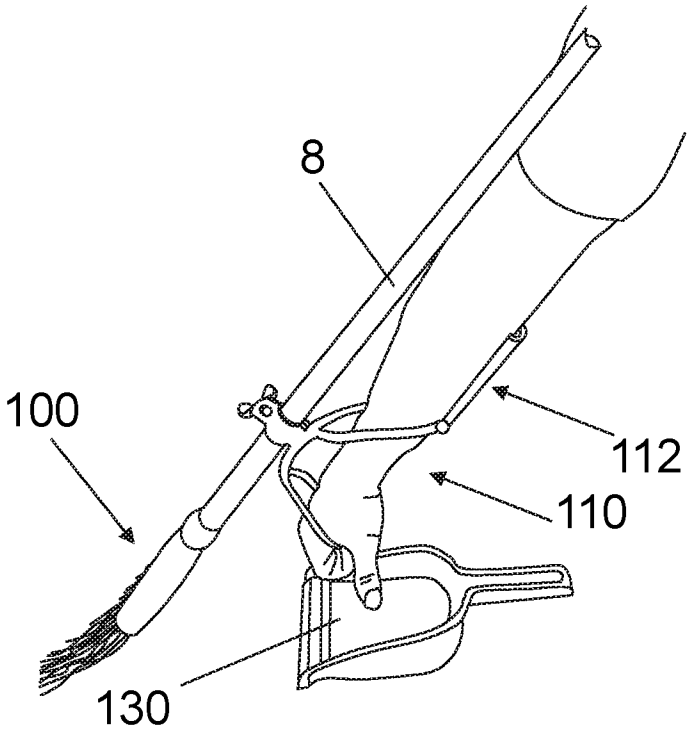
FIG. 17 is a side view of an embodiment of the versatile extension grip of the present invention affixed to a broom with a dust pan.
Figure 19:
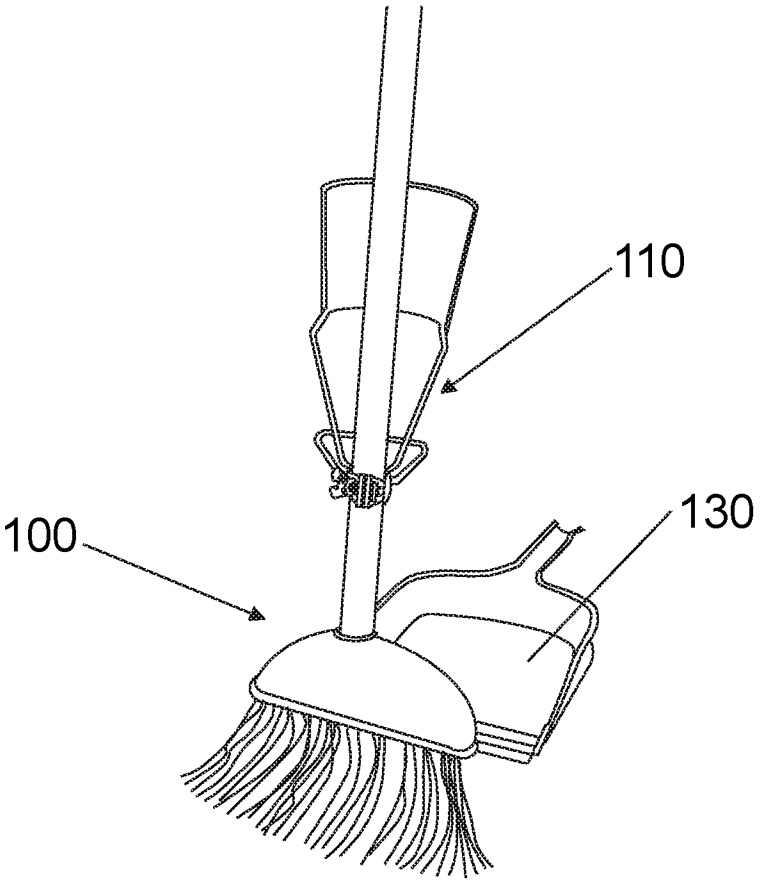
FIG. 19 is a rear perspective view of an embodiment of the versatile extension grip of the present invention affixed to a broom with a dust pan.
Figure 22:
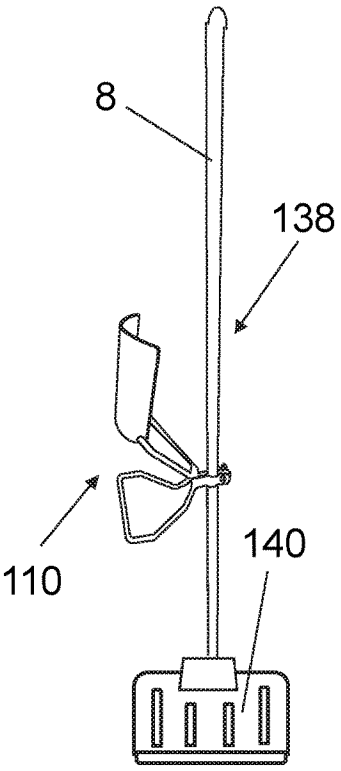
FIG. 22 is a perspective view of an embodiment of the versatile extension grip of the present invention affixed to a shovel.
Figure 21:
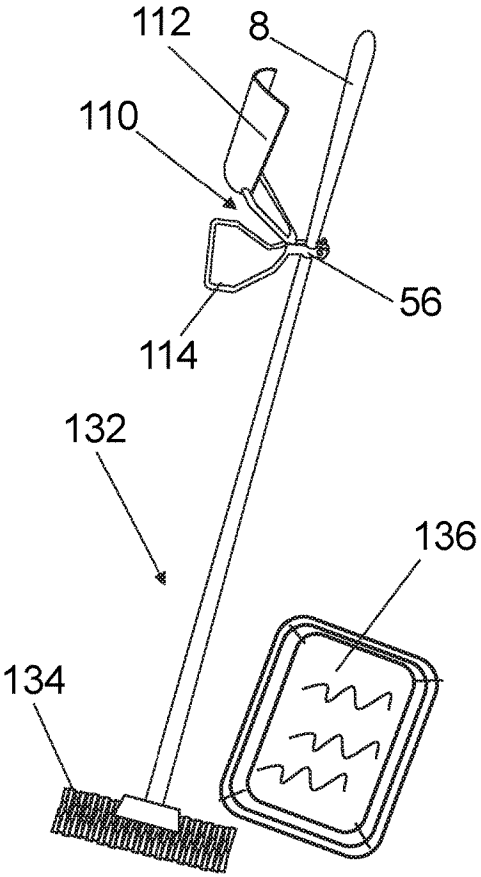
FIG. 21 is a perspective view of an embodiment of the versatile extension grip of the present invention affixed to a paint roller.
Figure 20:
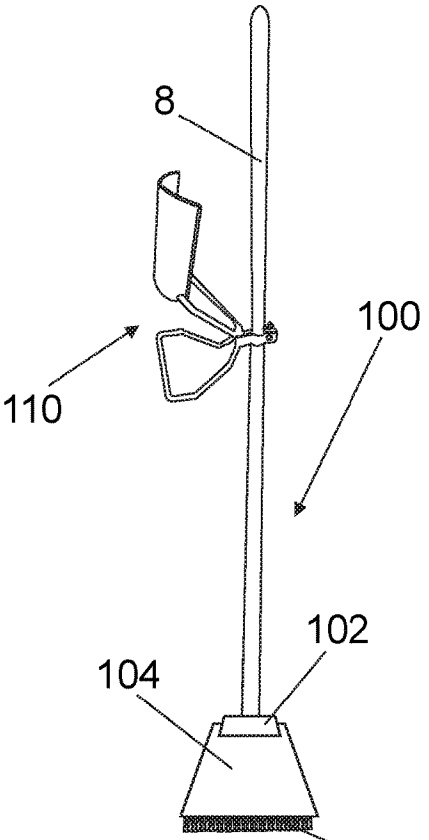
FIG. 20 is a perspective view of an embodiment of the versatile extension grip of the present invention affixed to a broom.

The support brace 112 may have frame pieces 126 that extend to connect a curved brace portion 128 that provides an area for a user's arm to be pressed against to provide leverage while using the tool. The user's arm may also simply rest against the curved brace portion 128 to provide ergonomic support and reduce fatigue from repeated arm movements while using the tool. The distance Di as shown in FIG. 12, is of an adequate dimension to provide for the user to insert their hand between the support brace 112 and the handle 8 and grasp the hand grip 114. As shown in FIG. 13, the versatile extension grip 110 of the present invention is removably attached to the handle 8 of a broom 100. As shown in FIG. 14, the user inserts their arm in between the support brace 112 and the handle 8 and reaches to grasp the hand grip 114, as shown in FIG. 15. A dust pan 130 may be provided to collect the swept debris and the user may easily drag the broom bristles 106 along the floor to sweep debris into the dustpan 130. In this manner the user can steady the dust pan with their other hand or foot and using the versatile extension grip 110 have the added utility and comfort of manipulating the broom 100 using only one hand, as shown in FIG. 16. As shown in a side view in FIG. 17, the support brace 112 provides leverage to support the arm so that the user may hold the broom bristles 106 firmly to the floor when pulling the broom 100 to more easily and effectively manipulate the broom 100 when sweeping. Using the versatile extension grip 110, the broom can be easily pulled toward the user using only one hand without having to awkwardly support the broom or uncomfortably twist the arm around the broom to attempt to both hold the broom and sweep and hold the dustpan at the same time. As shown in FIG. 18, the versatile extension grip 110 may be slid or positioned out of the way, to provide for the broom 100 to be used normally with two hands. The versatile extension grip 110 can then be slid into a desired position when needed to more easily manipulate the broom 100 and if needed sweep with one hand, as shown in FIG. 19. When the task is completed, the wing bolt 124 can be loosened and the extension grip 110 may be removed from the handle 8. In further embodiments, the extension grip may have two grips attached at two separate points along the handle 8. As described herein and as shown in FIG. 20, the versatile extension grip 110 may be attached along the handle 8 of a broom 100 to assist in sweeping. As shown in FIG. 21, embodiments of the versatile extension grip 110 may be attached to a paint roller 132 to provide for a user to hold the handle 8 with one hand over the head and have sufficient force to hold the roller 134 against the surface being painted to assist in painting for example a high wall or ceiling. The extension grip 110 can further provide an extra reach when positioned at one end to place the roller 134 in a paint tray 136 when the user is on a ladder while painting. The user may grasp the hand grip 114 with their palm facing the handle 8 so that the lower, inner portion of the arm is supported and has leverage against the support brace 112. Alternatively, the palm may be facing away from the handle 8 so that the lower, outer portion of the arm is supported against the support brace 112. The extension grip 110 may also be used with a shovel 138 such as a snow shovel having a large scoop 140 to assist with lifting wet snow and other heavy loads. The extension grip 110 may be positioned closer to the scoop 140 of the shovel 140 to more easily lift. In some embodiments, the extension grip 110 may be permanently affixed to the handle 8, but the attachment fixture 116 or other method of attachment may provide for the extension grip 110 to still be movable along the handle 8 to properly adjust the location to meet the size of a particular user and to accommodate different requirements in performing a particular task. Alternatively, the extension grip 110 may be removably affixed to the handle 8 providing for the extension grip 110 to be attached to and then be taken off of the handle when not in use. The attachment of the extension grip 110 of the present invention provides for ease of use and maneuverability of any tool having a handle to assist in different tasks of reaching, pulling, and applying force while using the tool as required.

The invention has been described in detail with particular reference to certain preferred embodiments thereof, but it will be understood that variations and modifications can be effected within the spirit and scope of the invention.

What is claims is:

1. An extension grip, comprising:

a support brace;

a hand grip;

at least one attachment fixture to attach the support brace and hand grip to the handle of a tool;

the attachment fixture comprising at least one semicircular opening for the adjustment of an angle between the handle of the tool and the support brace; and wherein the support brace and handgrip are attached to the handle of a tool to provide for inserting a hand through the attachment fixture to grasp the hand grip to provide leverage and maneuverability.

2. The extension grip of claim 1 wherein the support brace is pivotally attached to the handle of the tool.

3. The extension grip of claim 1 wherein the hand grip is pivotally attached to the handle of the tool.

4. The extension grip of claim 1 wherein the extension grip is removably attached to the handle of the tool.

5. The extension grip of claim 1 wherein the extension grip is permanently attached to the handle of the tool.

6. The extension grip of claim 1 wherein the extension grip slides along the handle of the tool.

7. The extension grip of claim 1 wherein the tool is a broom.

8. The extension grip of claim 1 wherein the tool is a paint roller.

9. The extension grip of claim 1 wherein the tool is a fruit picker.

10. The extension grip of claim 1 wherein the tool is a shovel.

11. The extension grip of claim 1 wherein the attachment fixture comprising at least one semicircular opening for the adjustment of an angle between the handle of the tool and the hand grip.

12. The extension grip of claim 1 wherein the attachment fixture comprising at least one cross shaped opening for the adjustment of an angle between the handle of the tool and the support brace.

13. The extension grip of claim 1 wherein the attachment fixture comprising at least one cross shaped opening for the adjustment of an angle between the handle of the tool and the hand grip.

14. The extension grip of claim 1 wherein the attachment fixture comprises a cylindrical body, extension tab, a semicircular support extension, and flanges.

15. The extension grip of claim 1 wherein the support brace comprises a curved brace portion.

16. The extension grip of claim 1 wherein the hand grip comprises a cushioned grip.

17. A method of providing leverage and maneuverability to a tool comprising the steps of:

affixing a support brace to a handle of a tool;

affixing a hand grip to the handle of a tool;

inserting a hand between the support brace and the handle of a tool to grasp the hand grip to provide for the forearm to be pulled against the support brace to gain added leverage and more easily maneuver the tool.

18. The method of providing leverage and maneuverability to a tool of claim 17 comprising the step of:

pivotally attaching the support brace and hand grip to the tool to provide for adjustment to accommodate the length and size of a user's hand and arm.

19. An extension grip, comprising:

a support brace;

a hand grip;

at least one attachment fixture to attach the support brace and hand grip to the handle of a tool, the at least one attachment fixture configured to adjust the space between the support brace and the handle of the tool; and wherein the support brace and handgrip are attached to the handle of a tool to provide leverage and maneuverability by allowing a hand and forearm to be inserted through the attachment fixture and between the support brace and the handle of the tool to grab the hand grip.

20. The extension grip of claim 19 wherein the attachment fixture configured to adjust at an angle the space between the support brace and the handle of the tool.

* * * * *